US005667158A

United States Patent [19]

Bullock et al.

[11] Patent Number: 5,667,158

[45] Date of Patent: Sep. 16, 1997

[54] AUTOMATED BLEND RECLAIM SYSTEM FOR PHARMACEUTICAL TABLET COMPRESSION MACHINE

[75] Inventors: Brian C. Bullock, Wake Forest; Steven R. Nowicki, Raleigh, both of N.C.

[73] Assignee: Glaxo Wellcome Inc., RTP, N.C.

[21] Appl. No.: 447,950

[22] Filed: May 23, 1995

[51] Int. Cl.[6] ..... B02C 19/12; B02C 25/00

[52] U.S. Cl. ..... 241/33; 241/58; 241/79.1; 241/DIG. 27

[58] Field of Search ..... 241/57, 58, 79.1, 241/101.2, DIG. 27, 33

[56] References Cited

U.S. PATENT DOCUMENTS

| | | | |
|---|---|---|---|
| 2,043,086 | 6/1936 | Westin et al. . | |
| 3,601,321 | 8/1971 | Barth et al. | 241/3 |
| 4,247,227 | 1/1981 | Gohler et al. . | |
| 4,277,260 | 7/1981 | Browning . | |
| 4,823,731 | 4/1989 | Howeth . | |
| 5,002,594 | 3/1991 | Merritt . | |
| 5,261,934 | 11/1993 | Shutic et al. . | |
| 5,509,612 | 4/1996 | Gerteis | 241/101.4 |

FOREIGN PATENT DOCUMENTS

| | | |
|---|---|---|
| 0 117 642 A1 | 9/1984 | European Pat. Off. . |

*Primary Examiner*—John M. Husar

*Attorney, Agent, or Firm*—Richard E. Jenkins; Charles E. Dadswell

[57] ABSTRACT

In combination an automated blend waste reclaim apparatus and a pharmaceutical tablet compression machine to facilitate reintroduction of blend into the tablet compression machine and comprising a filter operatively connected to the bulk material container of the tablet compression machine which serves to collect excess blend being pneumatically removed from the tablet compression machine. A blast of compressed air serves to periodically remove blend from the filter, and the blend is then caused to be reintroduced into the bulk material container of the pharmaceutical tablet compression machine.

28 Claims, 4 Drawing Sheets

AUTOMATED BLEND RECLAIM SYSTEM FOR PHARMACEUTICAL TABLET COMPRESSION MACHINE

TECHNICAL FIELD

The present invention relates to pharmaceutical tablet compression machines, and more particularly to an automated blend reclaim apparatus for reintroducing blend waste into a pharmaceutical tablet compression machine.

RELATED ART

As is well known to those skilled in the art of manufacture of pharmaceutical tablets, pharmaceutical tablet compression machines tend to accumulate dust along the turret, etc. of the tablet compression machine. Presently, the tablet blend dust is collected by the use of a conventional cyclone dust collector system associated with the machine to extract the blend dust. Upon completion of the manufacture of a batch of the blend into tablets, the accumulated blend dust in the dust collector system is typically weighed, recorded as waste and transported to a remote location for incineration.

Although effective in removing blend dust from the environment of the pharmaceutical tablet compression machine, the conventional blend dust removal system results in a significant loss of valuable tablet blend powder. Thus, there has been a long-felt-need for an effective blend powder recycling system to reclaim blend waste created during tablet manufacture and recycle the blend back to the pharmaceutical tablet compression machine for reuse.

DISCLOSURE OF THE INVENTION

In accordance with the present invention, applicants provide an automated blend reclaim apparatus for reintroducing blend waste into the bulk material container of a pharmaceutical tablet compression machine so that blend waste can be used by the tablet compression machine and substantial cost savings achieved. The automated blend reclaim apparatus is utilized in combination with a pharmaceutical tablet compression machine of the type having a bulk material container for the tablet blend mounted thereon and comprises a housing operatively connected to the bulk material container of the tablet compression machine with an aperture in the bottom thereof. Filter means is mounted within the housing and over the aperture, and vacuum blower means is located remote from the housing. First conduit means extend from the tablet compression machine to the filter means, and second conduit means extend from the filter means to the vacuum blower means. Compressed air source means is fluidly connected to the second conduit means proximate to the filter means. A plurality of valve means are utilized including valve means provided between the filter means and the housing aperture in the first conduit, in the second conduit, and operatively associated with the compressed air means.

Finally, the automated blend reclaim apparatus utilizes control means adapted to cycle the apparatus through (1) an accumulation step wherein the vacuum blower means is actuated and the plurality of valve means are selectively actuated so as to collect blend on the filter means; (2) a purge step wherein the plurality of valve means are selectively actuated so that the compressed air source means is actuated and compressed air from the compressed air source means will remove blend from the filter means; and (3) a dump step wherein the plurality of valve means are selectively actuated so that the removed blend waste will be caused to drop from the filter means and through the housing aperture into the bulk material container of the tablet compression machine for reuse.

As will be appreciated by one skilled in the art, applicants contemplate that the automated blend reclaim apparatus utilized in combination with a pharmaceutical tablet compression machine is most suitably mounted within the top portion of the bulk material container but, in the alternative, the apparatus may be mounted outside of the bulk material container of the tablet compression machine as a matter of design choice.

It is therefore an object of the present invention to provide an automated blend reclaim apparatus for use in combination with a pharmaceutical tablet compression machine to reintroduce blend into the tablet compression machine.

It is another object of the present invention to provide an automated blend reclaim apparatus for use in combination with a pharmaceutical tablet compression machine so as to avoid waste disposal of blend dust collected during use of the compression machine and thereby achieve significant tablet manufacturing cost savings.

Some of the objects of the invention having been stated hereinbelow, other objects will become evident as the description proceeds, when taken in connection with the accompanying drawing as best described hereinbelow.

BEST MODE FOR CARRYING OUT THE INVENTION

Figure 1:
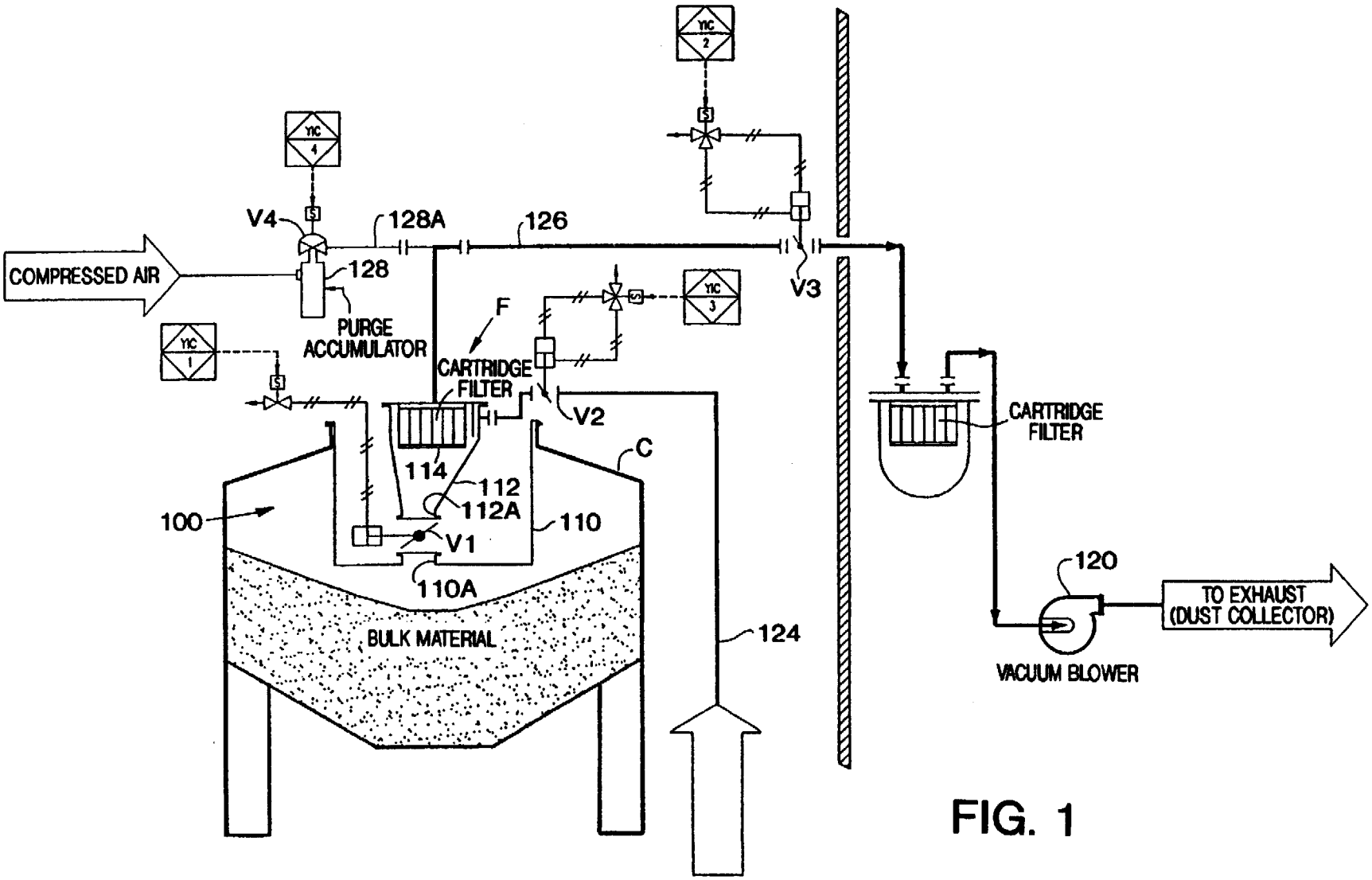
FIG. 1 is a schematic view of the automated blend reclaim apparatus of the invention in combination with a pharmaceutical tablet compression machine.
Figure 2:
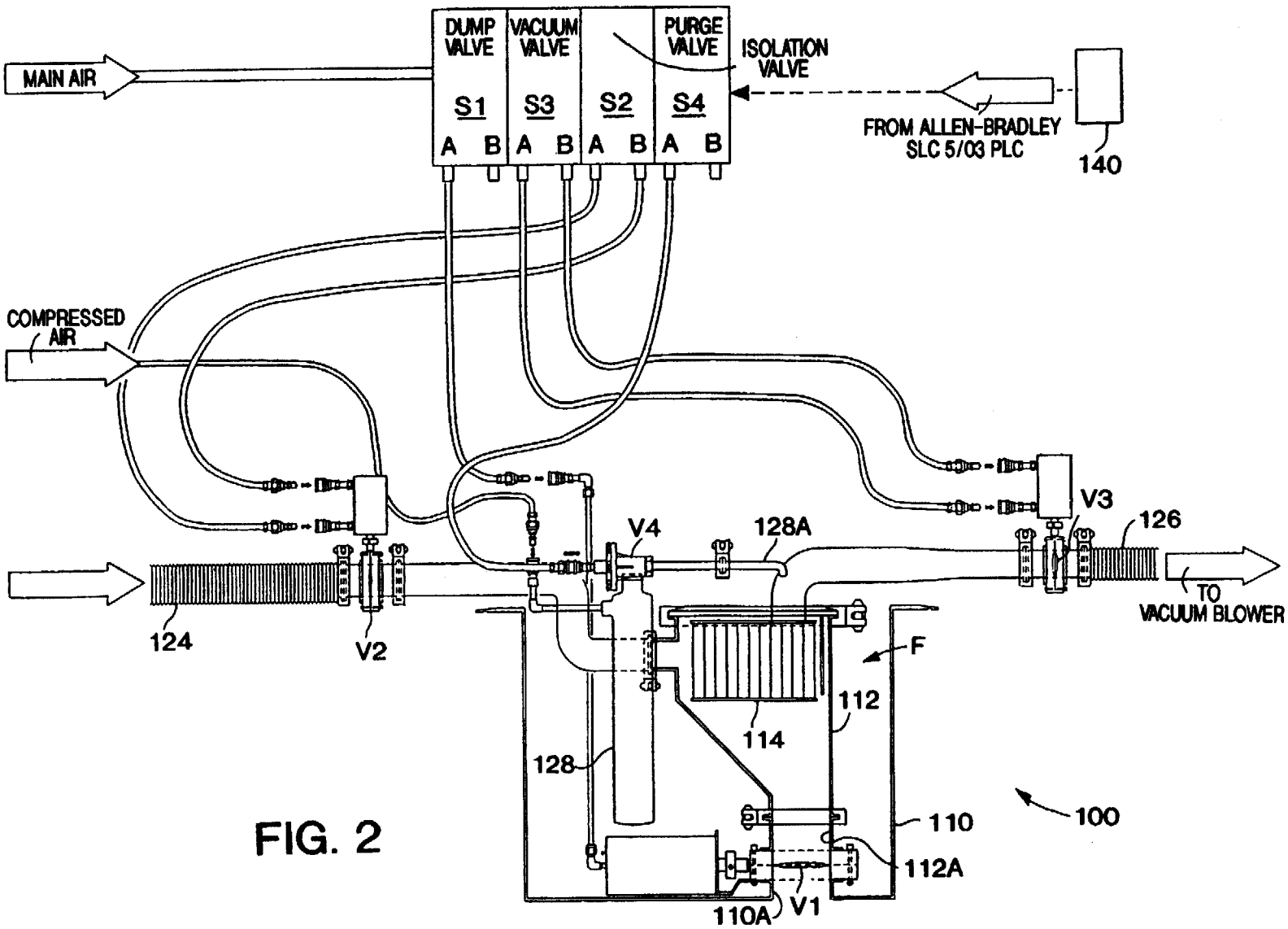
FIG. 2 is a vertical cross-sectional view of the automated blend reclaim apparatus of the present invention.
Figure 3:
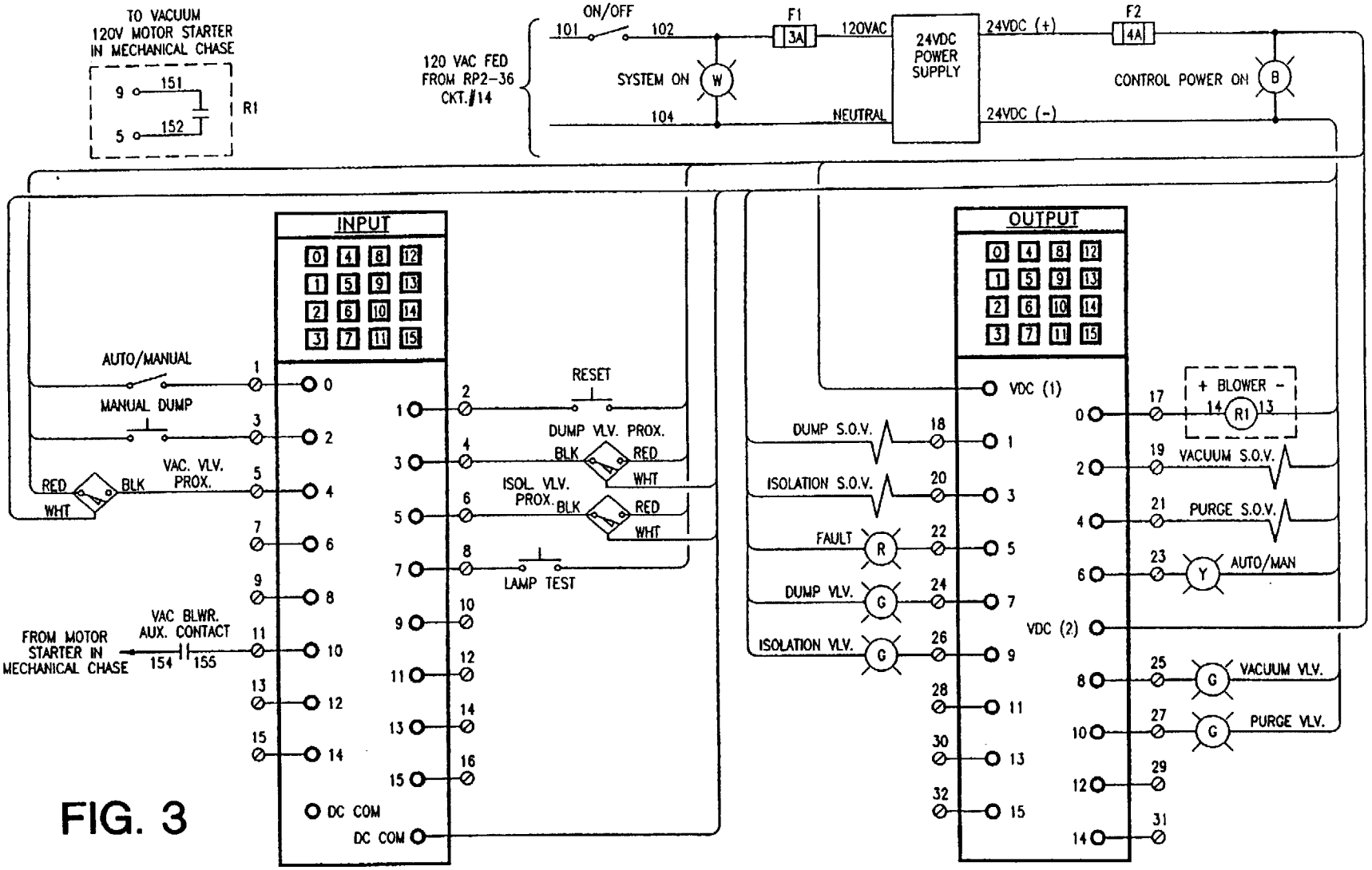
FIG. 3 is an electrical schematic diagram of the automated blend reclaim apparatus of the present invention.

Referring now more specifically to the drawings, a preferred embodiment of the automated blend reclaim apparatus for use in combination with a pharmaceutical tablet compression machine in accordance with the present invention is shown in FIGS. 1–3 and generally designated 100. Apparatus 100 is most suitably mounted within the upper portion of the bulk material container C of a pharmaceutical tablet compression machine as shown in FIG. 1, but may alternatively be mounted above or otherwise outside of the bulk material container of the pharmaceutical tablet compression machine as a matter of design choice.

Automated blend reclaim apparatus 100 comprises a drum 110, preferably formed of stainless steel, and secured within the top portion of bulk blend container C mounted above a pharmaceutical tablet compression machine. A collection apparatus F is provided in drum 110 which comprises a tapered canister 112, preferably formed from stainless steel, and a cartridge filter 114 mounted in the upper portion of canister 112. An aperture or opening 112A is defined at the bottom of filter canister 112 to facilitate dumping collected blend from filter 114 into bulk material container C in a manner to be described hereinafter. A vacuum blower 120, most suitably a SIEMENS brand Part No. ZBH-14170-HK-33Z, is provided at a remote location from canister 112. Hose line 114 is provided to extend from the collection manifold of the tablet compression machine (not shown) to an inlet in canister 112. Hose line 126 is provided to extend from cartridge filter 114 of canister 112 to vacuum blower 120. A compressed air source, most suitably an industrial air compressor, is connected to purge accumulator 128 provided adjacent canister 112 and fluidly connected to the proximal end of hose line 126 adjacent canister 112 by conduit 128A.

Four pneumatically controlled valves (V1–V3 are most suitably TRI-CLOVER brand Part No. B63-6100-3-E-S valves and V4 is an ASCO brand Part No. 8353C33 valve) are provided to control automated blend reclaim apparatus 100 comprising a first valve V1 positioned between bottom aperture 112A of filter canister 112 and an aperture 110A provided at the bottom of drum 110 so as to selectively allow blend from canister 112 to be dumped into bulk material container C of the pharmaceutical tablet compression machine. Second pneumatically controlled valve V2 is provided in hose line 124 leading from the vacuum blower 120 to canister 112, and third pneumatically controlled valve V3 is provided in hose line 126 extending from the tablet compression machine to canister 112. A fourth pneumatically controlled valve is provided at the output end of purge accumulator or compressed air source 128 and in fluid communication with conduit 128A.

Four solenoid valves, most suitably HUMPHREY Part No. HW 240-4E1-L-24 BDC solenoid valves, are utilized to selectively actuate corresponding pneumatically controlled valves V1–V4. Specifically, valve V1 is hydraulically connected to solenoid dump valve S1; valve V2 is pneumatically connected to solenoid isolation valve S2; valve V3 is pneumatically connected to solenoid vacuum valve S3; and valve V4 is pneumatically connected to solenoid purge valve S4.

As can be appreciated with reference to the drawings, solenoid valves S1–S4 are electrically connected to a suitably programmed PLC (programmable logic controller) 140, most suitably a ALLEN-BRADLEY SLC-5/03 programmable logic controller. PLC controller 140 is utilized to control the sequencing of valves V1–V4 to provide an automated process consisting of (1) an accumulation stage wherein blend material is collected from the vacuum ports through the collection manifold of the tablet compression machine and transported to canister 112; and (2) a dump stage wherein after a predetermined period of accumulation the blend is dumped from canister 112 and introduced back into bulk material container C by actuation of compressed air source 128 for a predetermined period of time and subsequent actuation of valve V1 for a predetermined period of time in a manner which will be described in greater detail hereinafter.

Figure 4:
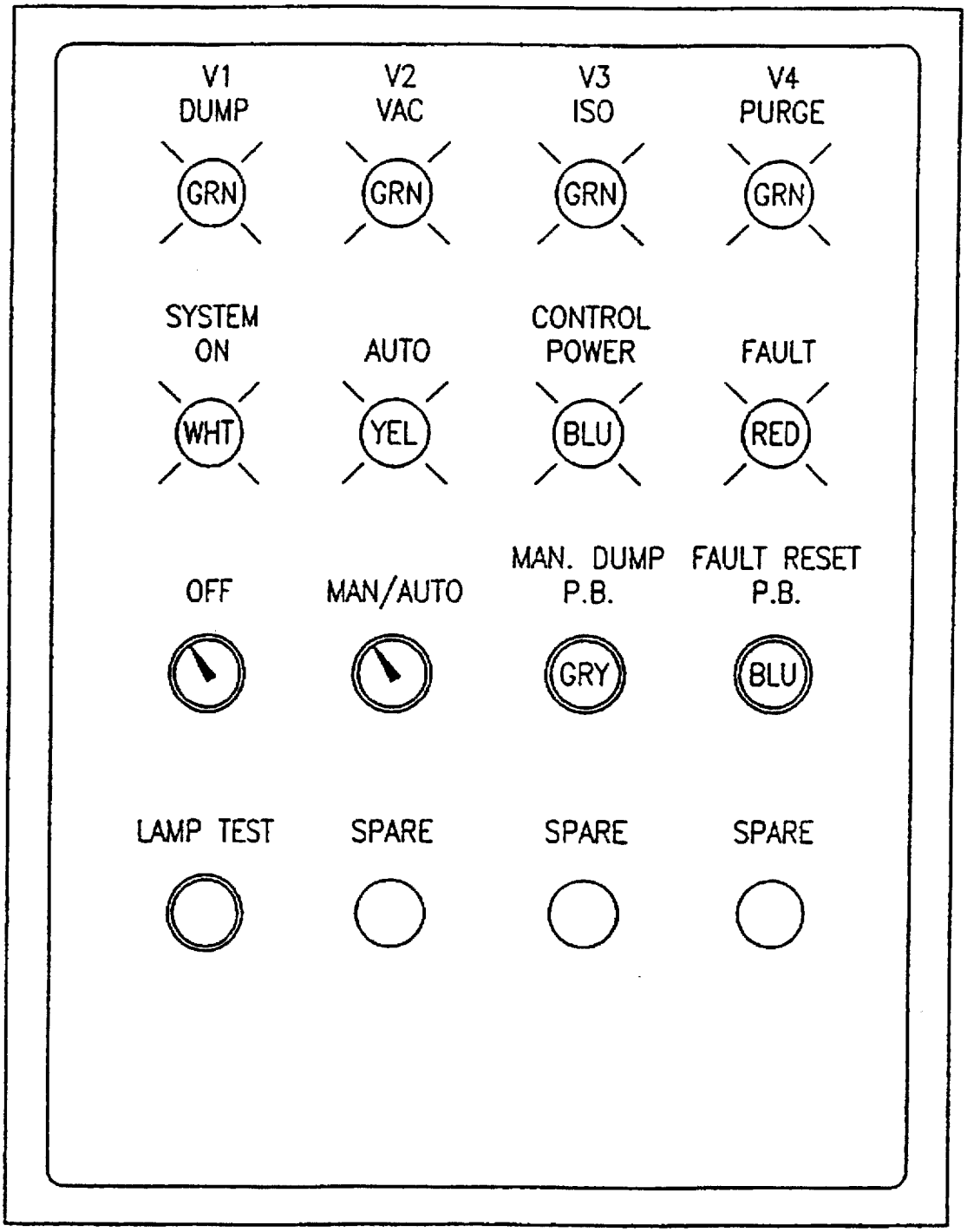
FIG. 4 is a schematic diagram of a control panel for the automated blend reclaim apparatus of the present invention.

Finally, it should be appreciated that compressed air is provided to compressed air source 128 and solenoid valves S1–S4 by conventional means which will not be discussed in detail herein. Also, as a matter of design choice, applicants contemplate that automated blend reclaim apparatus 100 may be operated from a control panel (see FIG. 4) which is used by the operator to actuate vacuum blower 120 and PLC 140. A preferred electrical schematic for apparatus 100 is set forth in FIG. 3 of the drawings, but applicants contemplate that other electrical circuits are contemplated as within the scope of the invention and would be a matter of design choice by one skilled in the art. Automated blend reclaim apparatus 100 is contemplated to utilize automated control by PLC 140 during its intended usage, but a manual control may be provided for manual control of apparatus 100 from time to time at the discretion of the operator.

Operation of Automated Blend Reclaim Apparatus

As previously noted, the function of apparatus 100 is to allow for recovery of previously discarded blend which is inherent in manufacturing pharmaceutical tablets with compression machines such as the COURTOY R200. By providing a PLC controlled blend recovery apparatus directly connected to the bulk material container of the tablet compression machine the previously discarded blend can be reintroduced to the tablet compression machine and significant cost savings achieved.

Apparatus 100 is most suitably mounted within the top portion of bulk material container C but may be mounted above container C if desired. Once apparatus 100 is in place on bulk material container C, container C (known to those skilled in the art as the "BULS Cube") is positioned over the tablet compression machine press and readied for operation. Vacuum blower 120 is actuated and PLC 140 is actuated in order to place apparatus 100 under the control of PLC 140. The automated process of apparatus 100 normally consists of two stages.

1. Accumulation Stage

The accumulation stage has a preferred duration of about 120 seconds, and during this stage blend is collected from the vacuum ports through the collection manifold of the tablet compression machine and transported to filter F where it is collected on cartridge filter 114. During the accumulation stage, dump valve V1 and purge valve V4 are closed, and vacuum valve V3 and isolation valve V2 are open to allow for vacuum to pull the blend away from the tablet compression machine and into canister 112.

2. Purge/Dump Stage

During the purge step of the purge/dump stage, vacuum valve V3 and isolation valve V2 are closed and dump valve V1 is maintained in a closed state. Next, purge valve V4 is opened, most suitably for about 1 second, to allow a blast of compressed air to clear the blend off of cartridge filter 114. When the purge step of this stage is completed, PLC 140 proceeds to a pause step of the purge/dump stage during which all 4 valves V1–V4 are closed for about 2 seconds so as to allow purge valve V4 time to close.

When the pause step of the purge/dump stage is completed, PLC 140 proceeds to the dump step of the dump/purge stage, wherein dump valve V1 is opened, preferably for about 8 seconds, and vacuum valve V3, isolation valve V2 and purge V4 valve are maintained closed. The dump step of the purge/dump stage allows collected blend to empty from filter canister 112 through dump valve V1 and through aperture 110A of drum 110 into bulk material container C. When the dump step is completed, PLC 140 returns to the accumulation stage and restarts the cycle.

It will be appreciated that the precise sequences and times set forth above have been found to be desirable, however applicants have described the sequences and times only as an illustration of one embodiment of the present invention but do not intend to be limited thereby since numerous variations of the sequences and times are possible and within the intended scope of applicants' invention as set forth in the appended claims.

Also, it will be appreciated that applicants contemplate that the blend reclaim system of the present invention could also be used in combination with tablet encapsulation machines, and that this combination is also contemplated by applicants to be within the scope of the invention described and claimed herein.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination with a pharmaceutical tablet compression machine having a bulk material container for the tablet blend mounted thereon, an automated blend waste reclaim apparatus for reintroducing blend waste into the tablet compression machine comprising:

(a) a housing operatively connected to said bulk material container of said tablet compression machine and defining an aperture in the bottom portion thereof;

(b) filter means mounted in said housing and over said aperture;

(c) vacuum blower means located remote from said housing;

(d) first conduit means extending from said tablet compression machine to said filter means;

(e) second conduit means extending from said filter means to said vacuum blower means;

(f) compressed air source means fluidly connected to said second conduit means proximate to said filter means;

(g) a plurality of valve means including valve means provided between said filter means and said housing aperture, in said first conduit, in said second conduit, and operatively associated with said compressed air source means;

(h) control means adapted to cycle said automated blend reclaim apparatus through (1) an accumulation step wherein said vacuum blower means is actuated and said plurality of valve means are selectively actuated so as to collect blend on said filter means; (2) a purge step wherein said plurality of valve means are selectively actuated so that said compressed air source means is actuated and compressed air from said compressed air source means will remove blend from said filter means; and (3) a dump step wherein said plurality of valve means are selectively actuated so that the removed blend waste will be caused to drop from said filter means and through said housing aperture and into said bulk material container of said table compression machine.

2. The combination according to claim 1 wherein said housing comprises a cylindrical drum having an open top end and a closed bottom end wherein said aperture is in the bottom end thereof.

3. The combination according to claim 2 wherein said drum is stainless steel.

4. The combination according to claim 1 wherein said filter means comprises a downwardly extending filter housing canister defining an aperture at the lowermost end thereof in vertical registration with said housing aperture, and a cartridge-type filter mounted within said filter housing canister.

5. The combination according to claim 4 wherein said filter housing canister is stainless steel.

6. The combination according to claim 1 wherein said vacuum blower means comprises a vacuum blower with an input and an output and wherein said second conduit means is connected to the input and the output is fluidly connected to an exhaust dust collector.

7. The combination according to claim 1 wherein said first conduit means comprises a flexible hose fluidly connected at one end to the turret portion of said tablet compression machine and at the other end to said filter means.

8. The combination according to claim 1 wherein said second conduit means comprises a flexible hose fluidly connected at one end to said filter means and at the other end to said vacuum blower means.

9. The combination according to claim 1 wherein said compressed air source means comprises a compressed air accumulator connected to a source of compressed air.

10. The combination according to claim 1 wherein said plurality of valve means comprises:

(a) a first solenoid valve fluidly connected to a first air valve mounted between said filter means and said housing aperture;

(b) a second solenoid valve fluidly connected to a second air valve mounted within said first conduit means;

(c) a third solenoid valve fluidly connected to a third air valve mounted within said second conduit means;

(d) a fourth solenoid valve fluidly connected to a fourth air valve operatively connected to said compressed air source means.

11. The combination according to claim 1 wherein said control means comprises a programmable logic controller (PLC) to control the sequencing of said plurality of valve means of said blend waste reclaim apparatus.

12. The combination according to claim 1 wherein said accumulation step has a duration of about 120 seconds, said purge step has a duration of about 3–4 seconds and said dump step has a duration of about 8 seconds.

13. The combination according to claim 1 wherein said housing and said filter means of said automated blend reclaim apparatus are mounted in the top portion of said bulk material container of said tablet compression machine.

14. The combination according to claim 1 wherein said housing and said filter means of said automated blend reclaim apparatus are mounted outside of said bulk material container of said tablet compression machine.

15. The combination according to claim 1 wherein said tablet compression machine is a COURTOY R200 tablet press machine.

16. In combination with a pharmaceutical tablet compression machine having a bulk material container for the tablet blend mounted thereon, an automated blend reclaim apparatus for reintroducing blend into the tablet compression machine comprising:

(a) a housing mounted in the top portion of said bulk material container of said tablet compression machine and defining an aperture in the bottom portion thereof;

(b) filter means mounted in said housing and over said aperture;

(c) vacuum blower means located remote from said housing;

(d) first conduit means extending from said tablet compression machine to said filter means;

(e) second conduit means extending from said filter means to said vacuum blower means;

(f) compressed air source means fluidly connected to said second conduit means proximate to said filter means;

(g) a plurality of valve means including valve means provided between said filter means and said housing aperture, in said first conduit, in said second conduit, and operatively associated with said compressed air source means;

(h) control means adapted to cycle said automated blend waste reclaim apparatus through (1) an accumulation step wherein said vacuum blower means is actuated and said valve means in said first and second conduits are open and said other valve means are closed so as to collect blend waste on said filter means; (2) a purge step wherein said compressed air source means is activated and said valve means in said first and second conduits and associated with said compressed air source means are closed so that a blast of compressed air from said compressed air source means will remove blend from said filter means; and (3) a dump step wherein said valve means associated with said filter means are open and said other valve means are closed so that the removed blend waste will be transported from said filter means into said bulk material container of said table compression machine.

17. The combination according to claim 16 wherein said housing comprises a cylindrical drum having an open top end and a closed bottom end wherein said aperture is in the bottom end thereof.

18. The combination according to claim 17 wherein said drum is stainless steel.

19. The combination according to claim 16 wherein said filter means comprises a downwardly extending filter housing canister defining an aperture at the lowermost end thereof in vertical registration with said housing aperture, and a cartridge-type filter mounted within said filter housing canister.

20. The combination according to claim 19 wherein said filter housing canister is stainless steel.

21. The combination of claim 16 wherein said vacuum blower means comprises a vacuum blower with an input and an output and wherein said second conduit means is connected to the input and the output is fluidly connected to an exhaust dust collector.

22. The combination according to claim 16 wherein said first conduit means comprises a flexible hose fluidly connected at one end to the turret portion of said tablet compression machine and at the other end to said filter means.

23. The combination according to claim 16 wherein said second conduit means comprises a flexible hose fluidly connected at one end to said filter means and at the other end to said vacuum blower means.

24. The combination according to claim 16 wherein said compressed air source means comprises a compressed air accumulator connected to a source of compressed air.

25. The combination according to claim 16 wherein said plurality of valve means comprises:

(a) a first solenoid valve fluidly connected to a first air valve mounted between said filter means and said housing aperture;

(b) a second solenoid valve fluidly connected to a second air valve mounted within said first conduit means;

(c) a third solenoid valve fluidly connected to a third air valve mounted within said second conduit means;

(d) a fourth Solenoid valve fluidly connected to a fourth air valve operatively connected to said compressed air source means.

26. The combination according to claim 16 wherein said control means comprises a programmable logic controller (PLC) to control the sequencing of said plurality of valve means of said blend waste reclaim apparatus.

27. The combination according to claim 16 wherein said accumulation step has a duration of about 120 seconds, said purge step has a duration of about 3–4 seconds and said dump step has a duration of about 8 seconds.

28. The combination according to claim 16 wherein said tablet compression machine is a COURTOY R200 tablet press machine.

* * * * *